United States Patent [19]

Lasinsky

[11] Patent Number: 5,041,332

[45] Date of Patent: Aug. 20, 1991

[54] MODIFIED FELT SEAM

[75] Inventor: Ellen Lasinsky, Castleton, N.Y.

[73] Assignee: Albany International Corp., Albany, N.Y.

[21] Appl. No.: 391,091

[22] Filed: Aug. 8, 1989

[30] Foreign Application Priority Data

Aug. 8, 1988 [GB] United Kingdom ..... 8818804.0

[51] Int. Cl.[5] ..... B32B 5/06

[52] U.S. Cl. ..... 428/58; 428/57; 428/193; 428/234; 428/280; 428/300

[58] Field of Search ..... 428/33, 40, 57, 58, 428/68, 224, 280, 233, 193, 234, 300

[56] References Cited

U.S. PATENT DOCUMENTS

| | | | |
|---|---|---|---|
| 2,718,791 | 9/1955 | Hose et al. | 428/193 |
| 2,883,734 | 4/1959 | Draper | 428/258 |
| 2,907,093 | 10/1959 | Draper | 28/141 |

*Primary Examiner*—James J. Bell

*Attorney, Agent, or Firm*—Ostrolenk, Faber, Gerb & Soffen

[57] ABSTRACT

This invention relates to A press felt for a paper making machine comprising a batt layer portion adapted to be positioned on a paper making machine juxtaposed the path of a paper web and a base weave portion designed to receive water from the paper sheet and to carry the batt layer, and means for jointing first and second ends of the felt to form a continuous belt, wherein the felt is provided at a first end portion with a flap in which the batt layer of the felt is configured to form a flap and at a second end portion, is configured to cooperate with said flap end portion characterized in that at least one of said end portions is coated with a hot melt adhesive whereby on the bringing of the first and second end portions into juxtaposition, the application of heat and pressure to bond said ends permits the formation of a seam in which the flap element overlays the remainder of the join in the felt.

7 Claims, 2 Drawing Sheets

MODIFIED FELT SEAM

DESCRIPTION

This invention relates to seamed press felts and has particular reference to a seamed press felt modified to reduce or substantially eliminate marking of a paper sheet by the felt during production of the paper.

In a paper making machine, when a newly formed sheet leaves the forming section, it has a moisture content typically between 70 and 80% depending on the type of paper making machine employed. On leaving the forming section, the thus formed sheet is passed through the press section where the sheet is advanced on a press felt through the press nip between press rolls where further water is expressed from the sheet. The press section includes several press nips in order to remove the maximum amount of remaining water in this section of the paper making machine.

A typical press felt comprises a soft surface batt layer portion which is positioned juxtaposed the paper web and serves to protect the latter, and a less compressible base weave portion designed to receive water from the paper sheet and carry it away in a press nip. Such a felt is hereinafter referred to as a "felt of the kind described". The essential features of a press felt are that it should be substantially uniform in properties to prevent any kind of marking of the paper during formation and pressing.

It will be appreciated that difficulty arises in the jointing of press felts since either the felts are made in a tubular fashion, or felts are made in longitudinal lengths and which need to be joined. Hitherto, only felts which are woven as endless felts have been acceptable since this tends to overcome the substantial discontinuity occasioned by other types of press felt joints. As an alternative to endless felts, loop seams in press felts have been proposed, for example, in U.S. Pat. Nos. 2,883,734 and 2,907,093, but because of the nature of the loops and seam area it is self-evident that woven, single layer felts where there is little protection between the seam loops and a paper web, marking of the paper web is as it passes a nip almost inevitable.

Straight joints have also been proposed by securing butt edges with a backing sheet, but again this produces a hardness in the nip which causes the marking of the paper.

Seamed press felts are gaining popularity in the paper industry because they allow for easier installation and reduce paper machine down time. However, their utility has been limited due to the tendency of flap wear and sheet marking.

According to the present invention, there is provided a press felt of the kind described having at a first end portion, a flap in which the batt layer of the felt is configured to form a flap, and a second end portion configured to cooperate with said flap end portion, characterised in that at least one of said end portions is coated with a hot melt adhesive whereby on the bringing of the first and second ends into juxtaposition, the application of heat and pressure to bond the said ends, permits the formation of a seam in which the flap element overlays the remainder of the join in the felt.

In another aspect of the present invention, the felt may be installed with a flap portion trailing in the machine direction of travel. The adhesive may be a polyamide hot melt adhesive and may typically be applied in a solution for example, by spraying. Where the adhesive is a polyamide hot melt adhesive, the solvent may be a methylene chloride/methanol mixture. The adhesive may typically be activated using a steam iron.

After such a felt has been installed on a paper mill, the hot melt adhesive may be activated via a hot air gun or steam iron, followed by pressure on the seam; the felt may thereafter be run. Tests have been conducted to show that the sprayed bonded seam in accordance with the present invention shows reduced wear when compared with an untreated control seam. In particular the Applicants have found that a press felt in accordance with the present invention, in which the hot melt adhesive is applied by solvent spraying, permits careful control of the quantity of adhesive which can be applied sufficient to obtain an adequate bond for the seam and at the same time, reduce or substantially eliminate the marking effect of the seam.

BRIEF DESCRIPTION OF THE DRAWINGS

Following is a description by way of example only, and with reference to the accompanying drawings of methods of carrying the invention into effect.

EXAMPLE 1

A 10% solution of a Bostik nylon (S319-72) hot melt solution in 1:1 methylene chloride:methanol was sprayed onto one half of the flap and trailing edge of a seam before seaming. A sprayer unit and multiple applications were used for this procedure.

The felt was seamed after installation on the experimental press section. The hot melt was activated using a steam iron, Setting 4.

Figure 2:
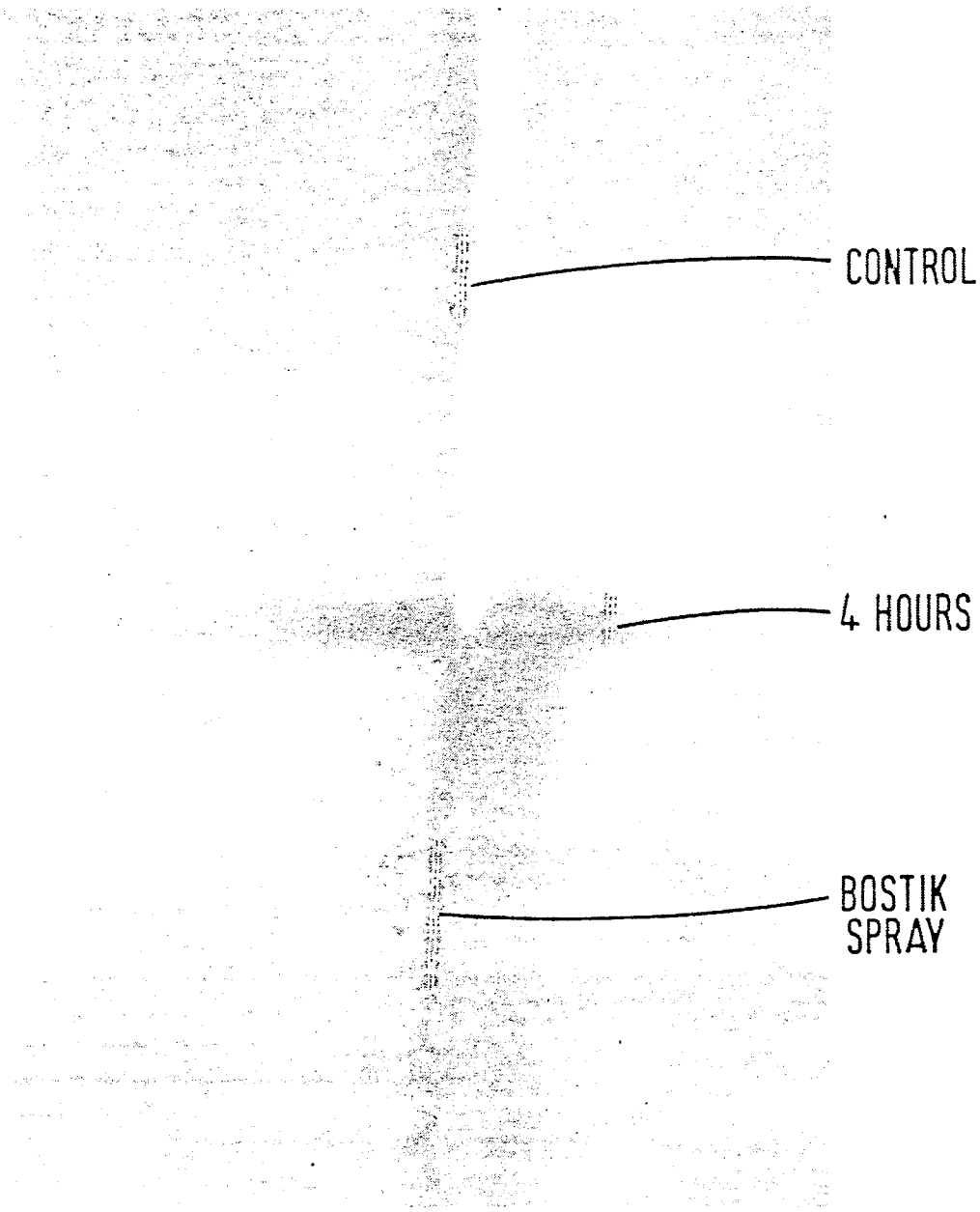
FIG. 2 shows the wear pattern of the seam of Example 1, part of which, part of which has been made in accordance with the present invention.

In order to test for reduced flap wear, the felt described above was subject to a an accelerated test on an experimental press section. The press running conditions were as follows: speed—2000 ft/min; oscillating needle showers at 280 psi at 15° angle into the face of the felt; nip pressure—450 psi; and a double slotted vacuum box at 15" Hg. The sprayed/bonded portion of the seam prepared by the method described above showed reduced wear when compared to the untreated control portion of the seam after 4 hours of accelerated testing on an experimental press. This is shown in FIG. 2 of the accompanying drawings.

From the figures it will be seen that the wear apparent on the control section of the seam is much more pronounced than that from the section marked "adhesive" in accordance with the present invention.

EXAMPLE 2

A 16% solution of a Bostik nylon (S319-72) hot melt adhesive in 1:1 methylene chloride:methanol was applied (two times) by atomizer spray unit in part of the seam area of a felt sample. The hot melt was activated using a steam iron, Setting 4.

The remainder of the seam was made up in a conventional manner and the sample and control areas were conditioned in the wet state by subjecting them to 500 compression cycles at 1000 psi. Both areas were subsequently evaluated for sheet marking utilizing Beloit carbon impressions at 500 and 1000 psi, and a dynamic press nip simulator using 100 g/m$^2$ bleached softwood kraft handsheets. The sample yielded reduced marking when compared to the untreated control. This is shown in FIG. 1.

Figure 1:
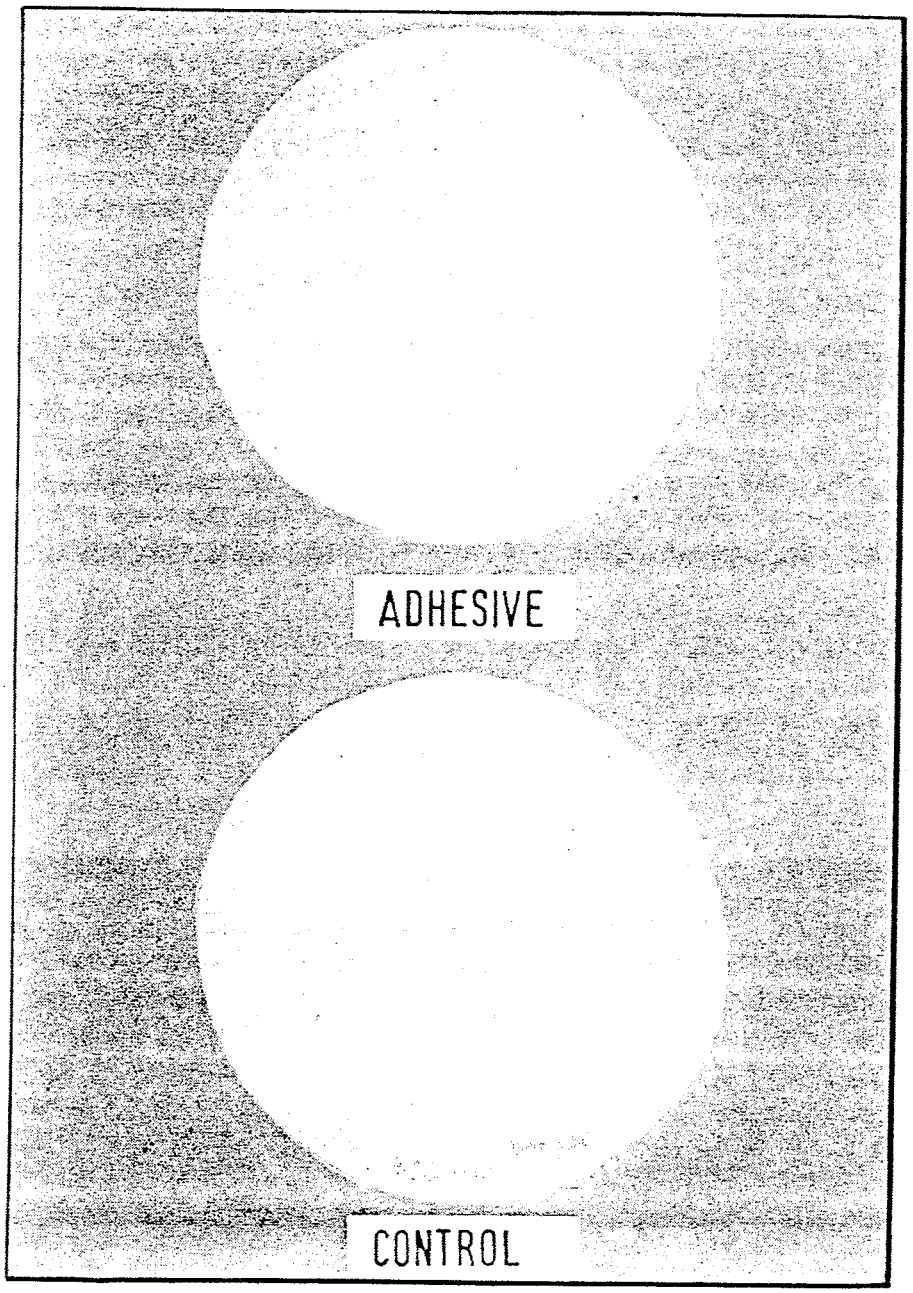
FIG. 1 shows an experimental and a control seam made in accordance with Example 2 of the examples below.

From FIG. 1 it will be seen that the marking from the sample marked "adhesive" in accordance with the present invention is less pronounced than that of the control.

I claim:

1. A press felt for a paper making machine comprising a batt layer portion adapted to be positioned on a paper making machine juxtaposed the path of a paper web and a base weave portion designed to receive water from the paper sheet and to carry the batt layer, and means for jointing first and second ends of the felt to form a continuous belt, wherein the felt is provided at a first end portion with a flap in which the batt layer of the felt is configured to form a flap and at a second end portion, is configured to cooperate with said flap end portion characterised in that at least one of said end portions is coated with a hot melt adhesive whereby on the bringing of the first and second end portions into juxtaposition, the application of heat and pressure to bond said ends permits the formation of a seam in which the flap element overlays the remainder of the join in the felt.

2. A felt as claimed in claim 1 in which the flap portion is trailing in the machine direction of travel.

3. A felt as claimed in claim 1 characterised in that the hot melt is a polyamide hot melt adhesive.

4. A felt as claimed in claim 1 characterised in that the hot melt adhesive is applied in solution.

5. A felt as claimed in claim 4 characterised in that the adhesive solution is applied by spraying.

6. A felt as claimed in claim 4 characterised in that the adhesive is a polyamide hot melt adhesive and the solvent is a methylene chloride/methanol mixture.

7. A felt as claimed in claim 1, characterised in that the hot melt adhesive is adapted to be activated by a hot air gun or steam iron followed by pressure on the seam after installation on a paper-making machine.

* * * * *